United States Patent [19]

Latif et al.

[11] Patent Number: 4,688,946

[45] Date of Patent: Aug. 25, 1987

[54] AUTOMATIC MIXING OF LIQUID ORGANIC COMPOUNDS

[75] Inventors: Sherif Latif, Marayong; Christopher S. Nieass, Lalor Park; Peter A. Warren, Beecroft, all of Australia

[73] Assignee: The BOC Group, Inc., Montvale, N.J.

[21] Appl. No.: 669,150

[22] Filed: Nov. 7, 1984

[30] Foreign Application Priority Data

Nov. 9, 1983 [AU] Australia ..... PG2302

[51] Int. Cl.[4] ..... B01F 15/02; B67C 3/20

[52] U.S. Cl. ..... 366/182; 366/132; 366/151; 366/348; 141/2; 141/3; 141/20

[58] Field of Search ..... 366/348, 150, 151, 160–162, 366/176, 177, 182, 139, 131, 132; 141/2-5, 7, 18, 20, 25

[56] References Cited

FOREIGN PATENT DOCUMENTS 1451841 10/1965 France .
1111534 5/1978 United Kingdom .
1546875 5/1979 United Kingdom .

*Primary Examiner*—Timothy F. Simone
*Attorney, Agent, or Firm*—David A. Draegert; Larry R. Cassett

[57] ABSTRACT

A method of automatically mixing predetermined quantities of liquid organic compound and liquid propellant is disclosed. A metering cylinder is filled from a storage reservoir of a liquid organic compound and then disconnected from the reservoir. Then one end of the metering cylinder is connected to a source of liquid propellant, the other end is connected to a mixing vessel, and vapour pressure of the liquid propellant is utilized to force all of the liquid organic compound into the mixing vessel, together with a predetermined volume of liquid propellant.

7 Claims, 4 Drawing Figures

AUTOMATIC MIXING OF LIQUID ORGANIC COMPOUNDS

This invention relates to a method and apparatus for measuring the ingredient components and mixing a solution of a liquid organic compound.

It is often necessary to fill a pressure vessel such as a gas cylinder with an accurate mixture of a liquid organic chemical and a propellant. An example is a liquid pesticide mixed in solution with a liquid propellant and used to provide an overhead spray in a warehouse, or a solution of a deodorant and propellant for spraying in theatres, as is described in co-pending application No. 25049/84. It has heretofore been difficult to exactly measure the desired portion of liquid organic chemical to liquid propellant.

An object of this invention is to overcome the difficulties in measuring, mixing and filling of such systems to ensure automatic and accurate successive operations.

The invention consists in a method of automatically mixing liquid organic compounds comprising the steps of:

filling a metering cylinder by connecting its top and bottom ends to a storage reservoir of liquid organic compound to allow fluid flow therebetween;

disconnecting said metering cylinder from said reservoir;

connecting said top end of said metering cylinder to a source of liquid propellant and connecting said bottom end of said metering cylinder to a mixing vessel, so that the vapour pressure of the propellant is utilized to force all of the contents of said metering cylinder into said mixing vessel, together with a predetermined volume of liquid propellant.

To ensure proper and complete filling of the metering cylinder it is usually located adjacent the organic compound storage reservoir at a level below the liquid level normally maintained in the reservoir.

To provide for quick and trouble-free operation three-way ball valves are employed throughout the system.

Switching other than 3-way valves may be employed. These may be pneumatic valves on solenoid valves for example:

The mixing vessel is usually a standard gas cylinder of the type approved for shipping compressed gases under pressures of around 3000 p.s.i. or 20 MPa and holding approximately 110 pounds or 50 Kg. of product.

By way of example an embodiment of the above described invention is described hereinafter with reference to the accompanying drawings in which.

Figure 1:
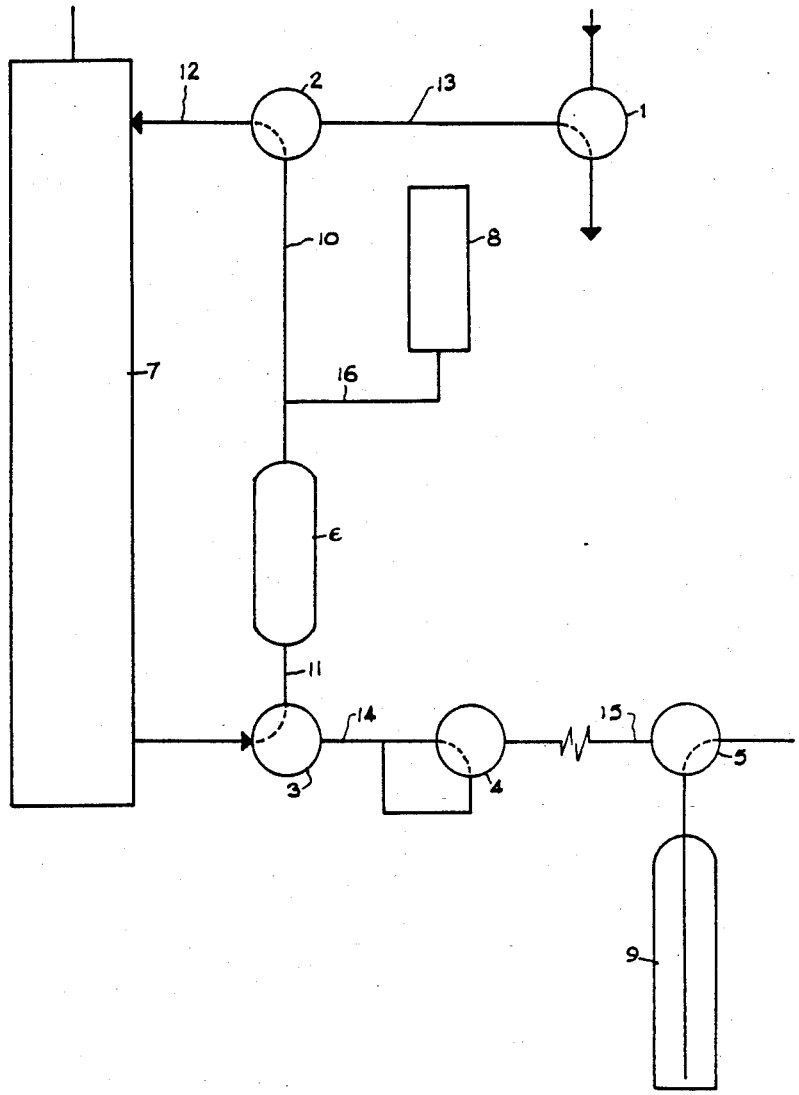
FIG. 1 is a schematic drawing of apparatus suitable for carrying out the invention with the valves positioned to carry out a first step of the method.
Figure 2:
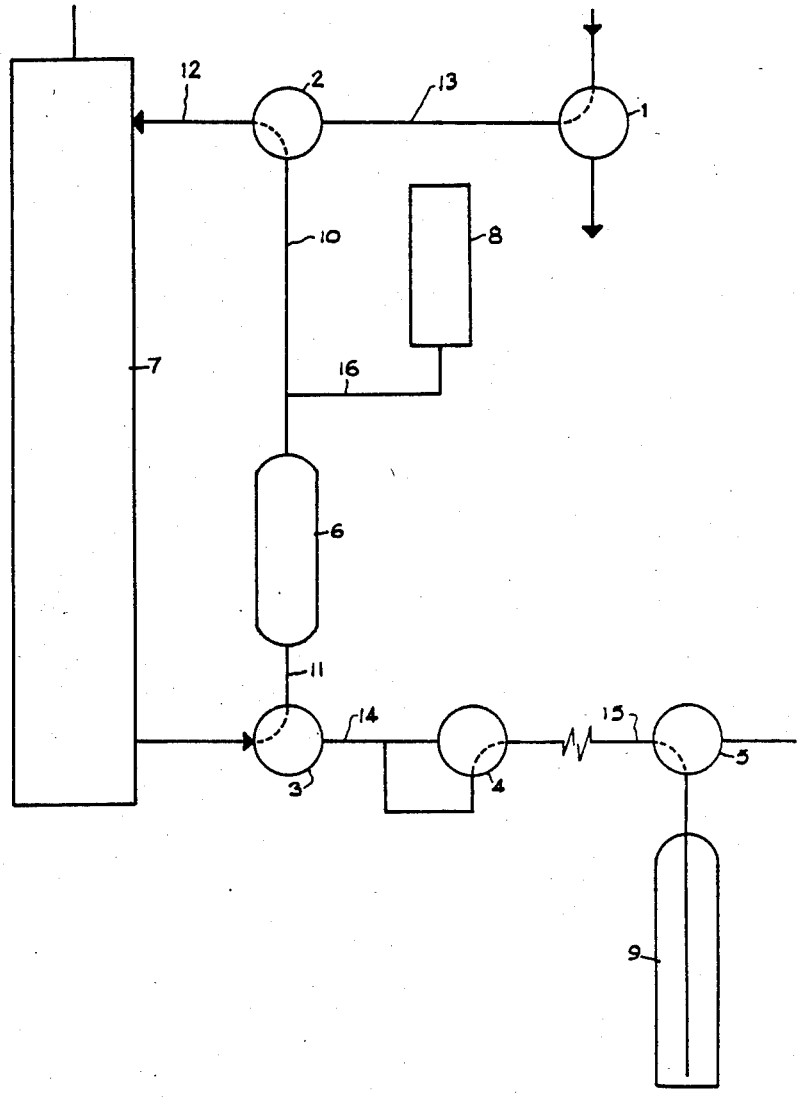
FIG. 2 shows the valves positioned in preparation for a second step.

With reference to FIG. 1, a metering cylinder 6 is made to a size whereby when it has the desired internal volume that together with the volume in the upper pipe 10 connecting its top end to 3-way valve 2 and the pipe 11 connecting its lower end to 3-way valve 3 exactly equals the discrete volume of a liquid organic chemical to be incorporated in a mixture with propellant in mixing vessel 9. Reservoir 7, which is open to atmospheric pressure, holds a large volume of the liquid organic chemical with its upper level always maintained at a height above pipe 12 connecting valve 2 with the reservoir at the top end of metering cylinder 6, so that when the valves 2 and 3 are positioned as shown in FIGS. 1 and 2 the metering vessel will be filled with the organic chemical.

Each of the three-way valves, 1, 2, 3, 4 and 5 is automatically controlled and positioned by hydraulic, mechanical, pneumatic or electrical means in recurring succession as will now be explained.

The second step in the operation is to connect a source of liquid propellant through valve 1 and pipe 13 to valve 2.

Figure 3:
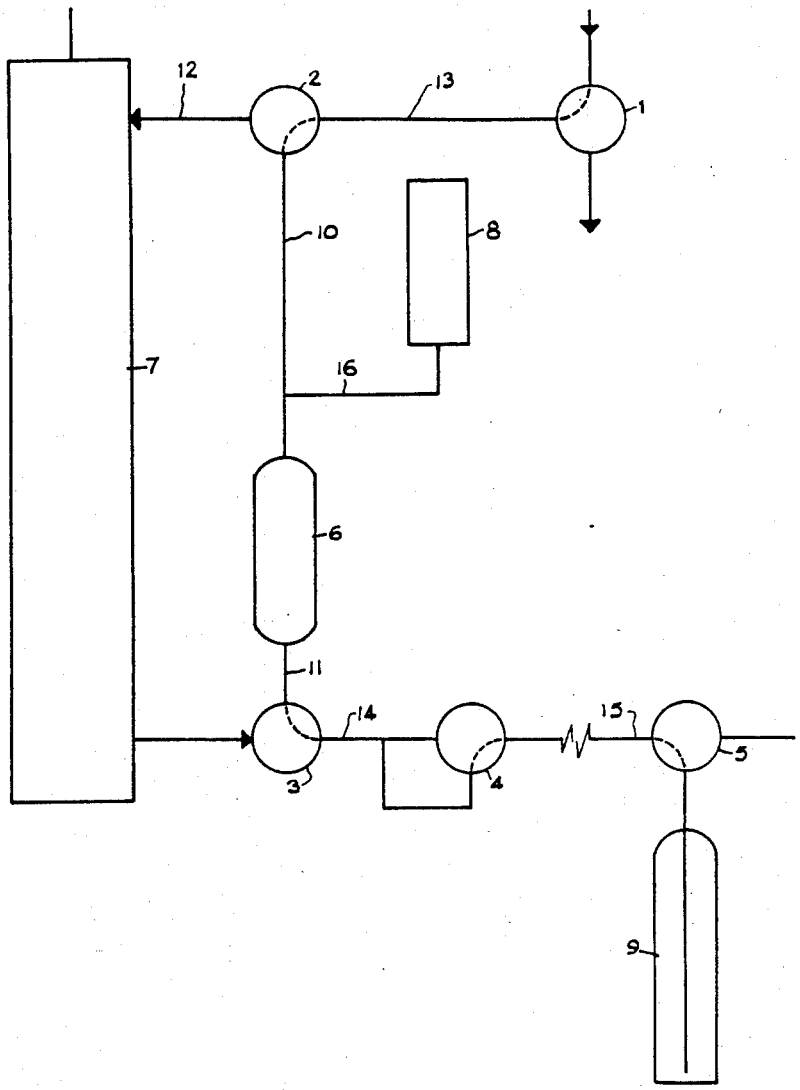
FIG. 3 shows the valves positioned to carry out the second step of FIG. 2.

When valve 2 is positioned as shown in FIG. 3 the liquid propellant by virtue of its vapour pressure moves through valve 2 into metering cylinder 6 forcing the total contents through pipe 11, valve 3, pipe 14, valve 4, pipe 15 and valve 5 into mixing vessel 9. Liquid propellant continues to flow into vessel 9 until the pressure in vessel 9 equals the vapour pressure of the propellant and the flow stops.

Figure 4:
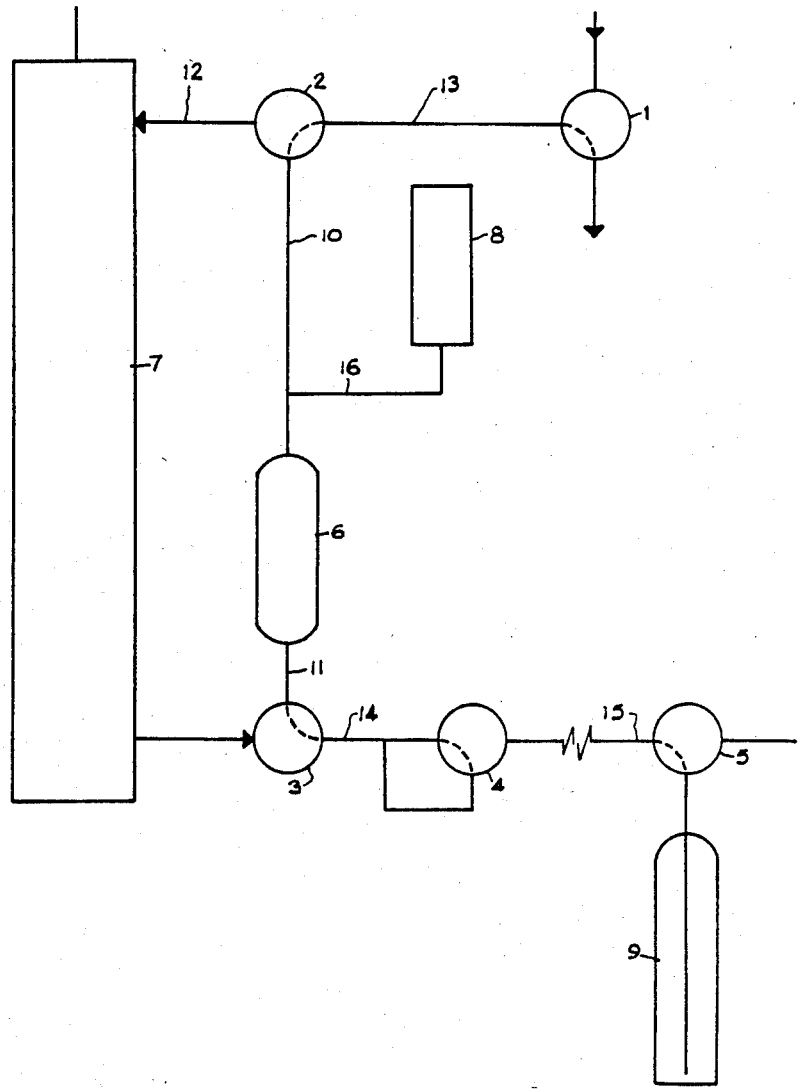
FIG. 4 shows the valves positioned to remove the filled mixing vessel.

Ullage vessel 8 connected to pipe 10 by pipe 16 is a single entry pressure vessel and serves as a safety measure to permit expansion of the liquid propellant in the interval of time between the filling of the mixing vessel 9 and the release of accumulated pressure when the mixing vessel is full and the 5 valves are positioned as shown in FIG. 4 to release the pressure in the system to atmosphere and return the system to atmospheric pressure so that the operation may be repeated for the mixing and filling of another mixing vessel 9.

It will be understood by those skilled in the art that the liquid propellant can be a fluorocarbon of the low pressure type R-11 or the higher pressure R-12 or R-22 or a liquified hydrocarbon or a mixture of fluorocarbons and hydrocarbons, or liquid carbon dioxide or a compressed gas. It has been found that when liquid carbon dioxide is used in this system it is preferable that it be supplied at a temperature in the range of 0° C. to 30° C. Accordingly a heat-exchange subsystem is included whereby bulk liquid carbon dioxide stored typically at −30° C. and at 300 psig is raised in both temperature and pressure.

We claim:

1. A method of automatically mixing predetermined quantities of liquid organic compound and liquid propellant, comprising the steps of:

connecting a metering cylinder having two ends to a storage reservoir of a liquid organic compound;

filling said metering cylinder with liquid organic compound by allowing liquid to flow from said reservoir into said metering cylinder;

disconnecting the filled metering cylinder from said reservoir;

thereafter connecting one end of said metering cylinder to a source of liquid propellant and connecting the other end of said metering cylinder to a mixing vessel; and utilizing the vapour pressure of the liquid propellant to force all of the liquid organic compound from said metering cylinder into said mixing vessel, together with a predetermined volume of liquid propellant.

2. The method according to claim 1, wherein the liquid propellant is liquid carbon dioxide.

3. The method according to claim 2, wherein the liquid organic compound is a pesticide.

4. The method according to claim 1, wherein the metering cylinder has top and bottom ends which are both connected to the storage reservoir.

5. The method according to claim 4, wherein both the top and bottom ends of the metering cylinder are connected at points below the surface of liquid organic compound in the reservoir.

6. The method according to claim 5, wherein the liquid propellant is liquid carbon dioxide.

7. The method according to claim 6, wherein the liquid organic compound is a pesticide.

* * * * *